United States Patent [19]

Stotz et al.

[11] 3,943,035

[45] Mar. 9, 1976

[54] BREAST BOX HAVING AN ADJUSTABLE LIP IN A PAPER MAKING MACHINE

[75] Inventors: Wolf Gunter Stotz, Ravensburg; Siegfried Reutter, Gerbertshaus, both of Germany

[73] Assignee: Sulzer Brothers Limited, Winterthur, Switzerland

[22] Filed: Apr. 15, 1974

[21] Appl. No.: 460,975

[30] Foreign Application Priority Data

Apr. 17, 1973 Switzerland ..... 5453/73

[52] U.S. Cl. ..... 162/272; 162/343; 162/347

[51] Int. Cl.[2] ..... D21F 1/04

[58] Field of Search ..... 162/272, 274, 317, 347, 162/199, 336, 343

[56] References Cited

UNITED STATES PATENTS

| | | | |
|---|---|---|---|
| 2,971,580 | 2/1961 | Beachler et al. | 162/347 X |
| 3,321,360 | 5/1967 | Holt | 162/317 |
| 3,734,821 | 5/1973 | Curtis | 162/317 |
| 3,839,149 | 10/1974 | Justus et al. | 162/317 |

*Primary Examiner*—Robert L. Lindsay, Jr.
*Assistant Examiner*—Richard V. Fisher
*Attorney, Agent, or Firm*—Kenyon & Kenyon Reilly Carr & Chapin

[57] ABSTRACT

The lip at the outlet of the nozzle duct is mounted along with the adjusting mechanism in a structural unit which is pivotally mounted on the casing. This allows the lip to be moved away from the permeable element to expose the nozzle duct and guide device for cleaning.

6 Claims, 2 Drawing Figures

BREAST BOX HAVING AN ADJUSTABLE LIP IN A PAPER MAKING MACHINE

Figure 1:
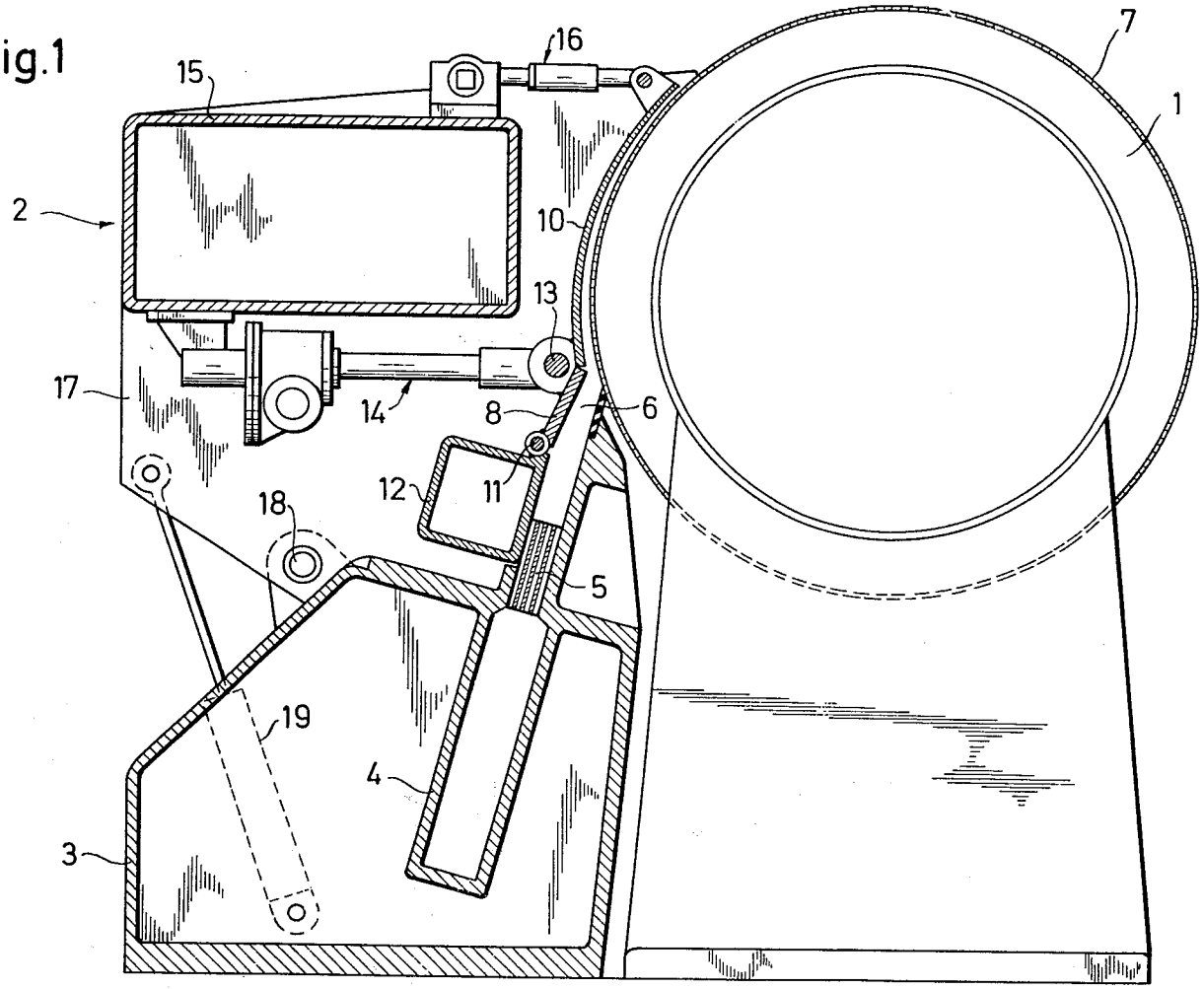

This invention relates to a breast box for a paper making machine and particularly to a breast box using an adjustable lip for controlling pulp feed to a permeable element.

Paper making machines have been known in which pulp is fed onto a permeable element for the formation of a paper web. In such machines, it has been usual to be able to control the amount of pulp fed to the permeable element for various reasons. For example, in one type of machine, it has been known to feed the pulp through a nozzle duct which terminates at the permeable element. In this case, the nozzle duct has been closed laterally by a lip which can be adjusted relative to the permeable element to adjust the height of the nozzle duct. Generally, the lip has been mounted to pivot about at least one pivot and an adjusting mechanism secured to a fixed support has been used to move the lip.

The breast boxes of such paper-making machines generally require cleaning fairly frequently to avoid the risk of dirtying which might cause interruptions in operation. To this end, breast boxes have been provided with lateral cleaning apertures through which the boxes can be cleaned or inspected. However, this has entailed very laborious procedures. Further, as a rule, the individual parts of the breast box have to be laboriously taken apart using lifting gear in order to permit cleaning.

Accordingly, it is an object of the invention to provide a breast box which can be readily opened in a relatively easy manner for cleaning.

It is another object of the invention to provide a breast box which is constructed in a manner to be opened by simple means.

It is another object of the invention to provide a breast box which can be readily opened for replacement of parts.

It is another object of the invention to provide a breast box in which parts can be made readily accessible.

Briefly, the invention is directed to a paper making machine having a breast box which is constructed with an adjustably mounted lip which laterally bounds a nozzle duct leading to a permeable element and a guide device which communicates with the nozzle duct to deliver pulp thereto. The machine includes a support means on which the lip is mounted along with an adjusting mechanism for moving the lip. This support means forms a structural unit with the lip and the related lip adjusting mechanism and, as such, is adjustably mounted on a casing of the machine so as to move the lip away from the permeable element to expose the nozzle duct and the guide device.

In a simple embodiment, the structural unit includes parallel walls and at least one support parallel to the lip and connected between the walls. The support, in turn, is connected to an adjusting mechanism for the lip. In this embodiment, the structural unit is pivotally mounted on the casing by means of pins which connect the respective walls of the unit to the casing.

The construction of the breast box allows a simple pivoting motion to be used to open the entire nozzle duct. This can be carried out by using, for instance, a hydraulic cylinder. The permeable element which may be in the form of a round or elongate screen is thus made readily accessible. Moreover, the guide device which can contain a large number of fine ducts is also made accessible for cleaning or replacement.

Figure 2:
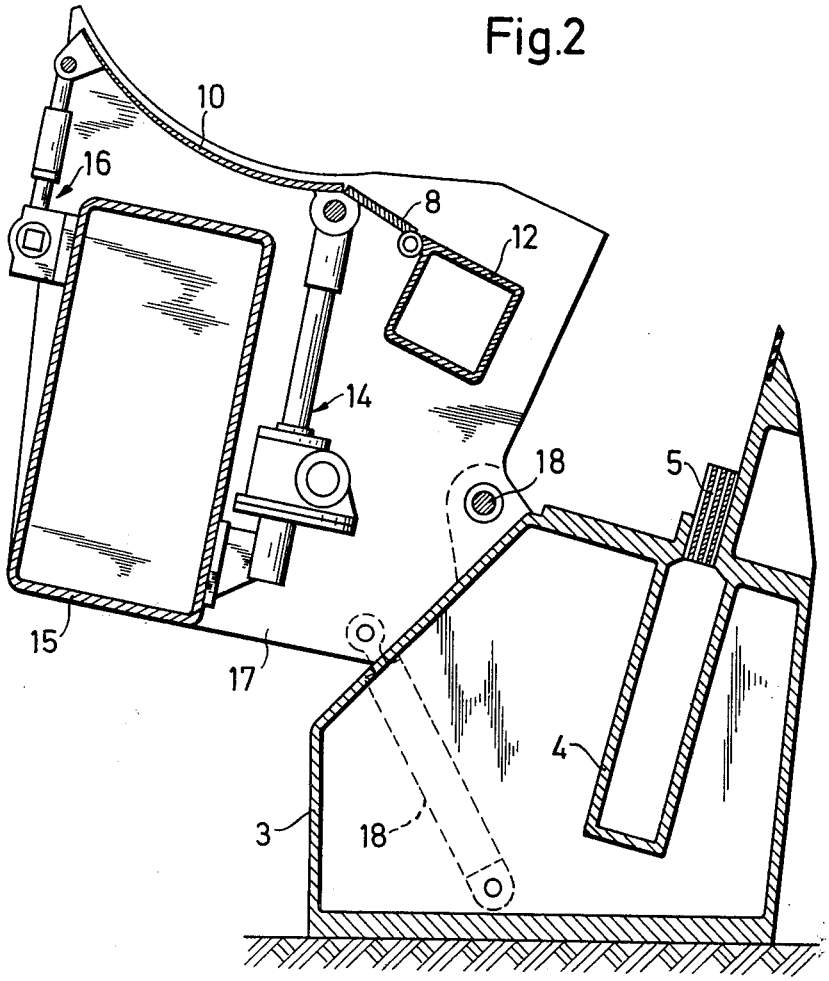

These and other objects and advantages of the invention will become more apparent from the following detailed description taken in conjunction with the accompanying drawings in which:

FIG. 1 illustrates a diagrammatic side view of a vacuum breast roll and breast box of a paper making machine constructed in accordance with the invention; and FIG. 2 illustrates a side view of the machine when in an opened condition.

Referring to FIG. 1, the paper making machine which is generally of known construction has a vacuum breast roll 1 connected with a suction system (not shown). The roll 1 is associated with a pulp feed 2 which includes a casing 3 which houses a distributing box 4 to which pulp, i.e. a suspension of paper fibers and additional materials in water, is fed from a source (not shown). The distributing box 4 distributes the pulp uniformly over the whole width of the paper-making machine. Adjoining the box 4 is a guide device 5 which can contain, for instance, a large number of fine ducts for distributing pulp supplied from the box 4. From the guide device 5, the pulp moves into a nozzle duct 6 which leads from the guide device 4 and terminates at a permeable element 7 disposed on the surface of the roll 1. The permeable element can be, for instance, a round or long screen (not shown) as is known.

As can be seen from FIG. 1, the nozzle duct 6 is bounded at one side by a lip which consists, for example, of two lip portions 8, 10 which can be adjusted independently of one another. The lower lip portion 8 is pivotably connected via a hinge 11 to a support 12 which extends along the whole of the lip 8, 10 in parallel relation. The upper lip portion 10 is also connected to the lower lip portion 8 via a hinge 13 which allows the two lip portions 8, 10 to make pivoting movements relative to one another. The hinge 13 is connected to a support 15 via one or more adjusting mechanisms 14. The upper end of the top lip portion 10 is connected to the support 15 via one or more adjusting mechanisms 16. The two adjusting mechanisms 14, 16 are so constructed as to enable the lip portions 8, 10 to be moved close up to the roll 1 or removed therefrom. The supports 12, 15 are attached to side walls 17 at the ends of the machine (FIG. 2).

Referring to FIGS. 1 and 2, a support means consisting of a pair of end walls 17 forms a structural unit with the supports 12, 15, adjusting mechanisms 14, 16, and lip 8, 10. The supports 12, 15 are connected in a suitable manner at the ends to the respective walls 17 in parallel to the lip 8, 10. The structural unit, in turn, is pivotally connected to the casing 3 by pins 18 and is moved via a suitable means such as one or more hydraulic cylinder devices 19 relative to the casing 3 between the respective positions shown in FIGS. 1 and 2.

FIG. 2 illustrates the breast box in a position in which the nozzle duct 6 is open. As can be seen, the connecting walls 17 have been pivoted to the left around the pins 18. That surface of the roll 1 which is not visible is freely accessible together with the guide device 5.

The embodiments of the invention in which an exclusive property or privilege is claimed are defined as follows:

1. In combination with a paper-making machine having a permeable element for forming a paper web;

a casing;

a pulp-feed including a guide device on said casing and a nozzle duct communicating with said guide device and terminating at said permeable element to deliver pulp thereto;

an adjustably mounted lip laterally bounding said nozzle duct relative to said permeable element;

an adjusting mechanism connected to said lip for moving said lip relative to said permeable element to adjust the height of said nozzle duct; and a support means supporting said adjusting mechanism and said lip thereon and forming a structural unit therewith, said structural unit being adjustably mounted on said casing for moving said lip away from said permeable element and said guide device to expose said nozzle duct and said guide device.

2. The combination as set forth in claim 1 wherein said structural unit is pivotally mounted on said casing.

3. The combination as set forth in claim 2 wherein said support means includes parallel walls, at least one support parallel to said lip and connected to said adjusting mechanism and between said walls, and a pin connecting each respective wall to said casing.

4. The combination as set forth in claim 1 wherein said pulp feed further includes a distributing box in said casing for distributing pulp through said guide device into said nozzle duct.

5. In a paper making machine, the combination comprising a casing housing a pulp distributing box and a guide device for distributing pulp supplied from said box;

a structural unit movably mounted on said casing, said unit including a lip for bounding a nozzle duct leading from said guide device and an adjusting mechanism connected to said lip for moving said lip to adjust the height of said nozzle duct; and means for moving said structural unit relative to said casing and said guide device to expose said nozzle duct and said guide device.

6. In a paper making machine as set forth in claim 5, said guide device including a number of fine ducts for distributing the pulp.

* * * * *